US005907215A

United States Patent [19]

Mougin et al.

[11] Patent Number: 5,907,215

[45] Date of Patent: May 25, 1999

[54] FLAT DISPLAY SCREEN WITH HYDROGEN SOURCE

[75] Inventors: Stephane Mougin, Castelnau Le Lez; Philippe Catania, Jacou; Olivier Hamon, Montpellier, all of France

[73] Assignee: Pixtech S.A., Rousset, France

[21] Appl. No.: 08/837,354

[22] Filed: Apr. 17, 1997

[30] Foreign Application Priority Data

Apr. 18, 1996 [FR] France ..... 96 05121

[51] Int. Cl.[6] ..... H01J 19/24; H01J 9/395

[52] U.S. Cl. ..... 313/496; 313/309; 313/336; 445/70

[58] Field of Search ..... 313/336, 309, 313/351, 495, 496, 497, 556, 562, 552; 445/70, 24; 430/23

[56] References Cited

U.S. PATENT DOCUMENTS 4,940,916 7/1990 Borel et al. ..... 313/309
5,144,191 9/1992 Jones et al. ..... 313/309
5,528,102 6/1996 Gnade et al. ..... 313/496
5,534,749 7/1996 Ohoshi et al. ..... 313/497
5,684,356 11/1997 Jeng et al. ..... 313/336
5,714,837 2/1998 Zurn et al. ..... 313/495

*Primary Examiner*—Sandra O'Shea
*Assistant Examiner*—Michael Day
*Attorney, Agent, or Firm*—Arthur L. Plevy

[57] ABSTRACT

A flat display screen includes a cathode (1) with microtips (2) for the electron bombardment of the anode (5) having phosphor elements (7*r*, 7*g*, 7*b*), the cathode (1) and the anode (5) separated by a vacuum space (12) containing a progressive hydrogen release source comprised of a thin layer of hydrogenated material. The progressive hydrogen release source may comprise a resistive layer (11) of the cathode (1) on which the microtips (2) are arranged. The progressive hydrogen release source provides the microtips (2) with a substantially constant emitting power.

3 Claims, 1 Drawing Sheet

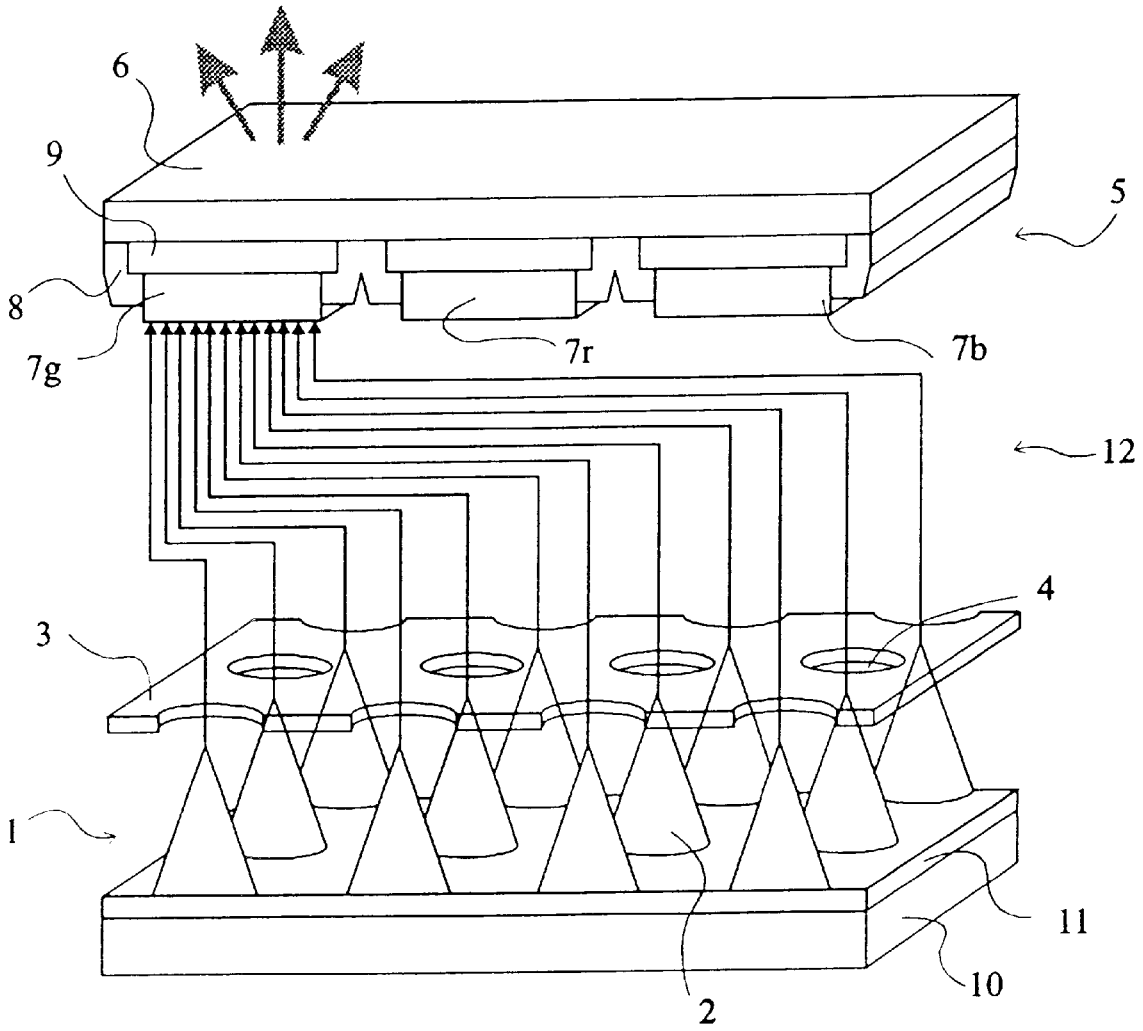
6
9
5
8
7g
7r
7b
12
4
3
1
11
10
2

FLAT DISPLAY SCREEN WITH HYDROGEN SOURCE

BACKGROUND OF THE INVENTION

1. Field of the Invention

The present invention relates to flat display screen, and more particularly to so-called cathodoluminescent screens, the anode of which carries luminescent elements, separated from one another by insulating areas, and likely to be energized by electron bombardment from microtips.

2. Discussion of the Related Art

The accompanying drawing shows an example of a flat microtip color screen of the type to which the present invention relates.

Such a microtip screen is essentially comprised of a cathode 1 having microtips 2 and of a grid 3 provided with holes 4 corresponding to the locations of microtips 2. Cathode 1 is placed facing a cathodoluminescent anode 5, a glass substrate 6 of which constitutes the screen surface.

The operating principle and a specific embodiment of a microtip screen are described, in particular, in U.S. Pat. No. 4,940,916 to Borel et al.

Cathode 1 is organized in columns and is comprised, on a glass substrate 10, of cathode conductors organized in meshes from a conducting layer. Microtips 2 are implemented on a resistive layer 11 deposited on the cathode conductors and are placed inside the meshes defined by the cathode conductors. The drawing partially shows the inside of a mesh and the cathode conductors are not shown therein. Cathode 1 is associated with grid 3 which is organized in lines. The intersection of a line of grid 3 and of a column of cathode 1 defines a pixel.

The device uses the electric field which is created between cathode 1 and grid 3 to extract electrons from microtips 2. These electrons then are attracted by phosphor elements 7 of anode 5 if the latter are properly biased. In the case of a color screen, anode 5 is provided with alternating phosphor bands 7*r*, 7*g*, 7*b*, each corresponding to a color (Red, Green, Blue). The bands are parallel to the columns of the cathode and are separated from one another by an insulator 8, generally silicon oxide ($SiO_2$). The phosphors 7 are deposited on electrodes 9, comprised of corresponding bands of a transparent conducting layer such as indium tin oxide (ITO). The sets of red, green, and blue bands are alternately biased with respect to cathode 1, so that electrons extracted from the microtips 2 of a pixel of the cathode/grid are alternately directed towards phosphors 7 facing each of the colors.

The selection control of phosphor 7 (phosphor 7*g* in the drawing) which is to be bombarded by the electrons from the microtips of cathode 1 imposes to control, selectively, the bias of the phosphors 7 of anode 5, color per color.

Generally, the rows of grid 3 are sequentially biased to a potential of approximately 80 volts, whereas the phosphor bands (for example, 7*g*) to be energized are biased under a voltage of approximately 400 volts via the ITO band on which the phosphors are deposited. The ITO bands, carrying the other phosphor bands (for example 7*r* and 7*b*), are at a low or zero potential. The columns of cathode 1 are brought to respective potentials included between a maximum emission potential and a zero emission potential (for example, respectively 0 and 30 volts). The brightness of a color component of each of the pixels in a line thus is set.

The selection of the values of the bias potentials is linked with the characteristics of phosphors 7 and of microtips 2. Conventionally, below a potential difference of 50 volts between the cathode and the grid, there is no electron emission, and the maximum emission used corresponds to a potential difference of 80 volts.

A disadvantage of conventional screens is that the microtips progressively lose their emitting power. This phenomenon can be acknowledged by measuring the current through the cathode conductors. As a result, the screen brightness progressively decreases, which is prejudicial to the lifetime of conventional screens.

SUMMARY OF THE INVENTION

The present invention aims at overcoming this disadvantage by making the emitting power of the microtips substantially constant.

The present invention also aims at providing a screen with automatic regulation of the emitting power of the microtips.

The present invention further aims at providing a method of implementation of a screen, the microtips of which have a substantially constant emitting power without modifying either the screen structure or the screen control means.

To achieve these objects, the present invention provides a flat display screen including a cathode with microtips for the electron bombardment of an anode having phosphor elements, the anode and the cathode being separated by a vacuum space, containing a progressive hydrogen release source comprised of a thin layer of a hydrogenated material.

According to an embodiment of the present invention, the hydrogen source is comprised of a resistive layer of the cathode on which the microtips are arranged.

According to an embodiment of the present invention, the hydrogen source is comprised of insulating bands separating bands of phosphor elements from the anode.

According to an embodiment of the present invention, the hydrogen source is implemented at the circumference of the active area of the anode carrying the phosphor, a source for energizing the hydrogen source being implemented, on the cathode side, facing the hydrogen source.

The present invention also provides a process for manufacturing a flat display screen, including the step of hydrogenating at least one of the conductive layers formed inside the screen.

According to an embodiment of the present invention, the hydrogenated layer is obtained by plasma-enhanced chemical vapor deposition from at least one hydrogen-enriched precursor.

The foregoing and other objects, features, aspects and advantages of the invention will become apparent from the following detailed description of the present invention when taken in conjunction with the accompanying drawing.

BRIEF DESCRIPTION OF THE DRAWING

FIG. 1 is a partial cross-sectional view of a flat display screen according to the invention.

For the sake of clarity, the figure is not drawn to scale.

DETAILED DESCRIPTION

The origin of the present invention is an interpretation of the phenomena generating the above-mentioned problems in conventional screens.

The inventors consider that these problems are due, in particular, to an oxidizing of the cathode microtips.

In a microtip screen, the surface layers of the anode are, from a chemical point of view, oxides, be it the phosphors 7 or insulator 8. Conversely, on the cathode side, the microtips generally are metallic, for example molybdenum (Mo).

The oxide layers tend to reduce as a result of electron bombardment, that is, to release oxygen which oxidizes the surface of the microtips which then lose their emitting power.

Based on this analysis, the present invention provides to control this cathode microtip oxidizing phenomenon by introducing a partial hydrogen pressure in the inter-electrode gap of the screen.

In a microtip screen, in the operating mode, the most negative potential is that of the metallic cathode material and ions $H^+$ or $H_2^+$ thus are attracted by the microtips to reduce them when they are oxidized. Conversely, these ions $H^+$ or $H_2^+$ are repulsed by the anode and do not risk to damage the phosphors.

The water vapor ($H_2O$) formed by recombination of ions $H^+$ or $H_2^+$ then is trapped by an impurity trapping element, generally called a "getter", which communicates with the electrode gap.

Indeed, a microtip screen generally is provided with a getter having the function of absorbing the various contaminations introduced by the degassing of the screen layers in contact with the vacuum. However, in conventional screens, this getter does not succeed in efficiently trapping the oxygen degassed by phosphor 7 and insulating layers 8 since the degassings are essentially performed in a positive ionic form ($O_2^+$) which is thus attracted by the microtips before the getter can trap it.

Conversely, the water vapor obtained by the reduction of the oxygen by the hydrogen ions constitutes a neutral molecule which then is no longer attracted by the microtips and can be trapped by the getter.

The partial hydrogen pressure must however not be too high in order not to harm screen operation.

Indeed, the presence of hydrogen in the vicinity of the microtips causes the formation of a hydrogen microplasma in the vicinity of the microtips. This plasma must stay at a sufficiently low pressure and must be located around the tips in order not to disturb screen operation. In particular, if this plasma develops, there is a risk of seeing an arc occur between the anode and the cathode of the screen.

The partial hydrogen pressure is selected according to the present invention according to the distance between the electrodes and to the screen vacuum quality, in particular, according to the partial pressure of the oxidizing species altogether.

As a specific example, a hydrogen partial pressure of $5.10^{-4}$ millibars ($5.10^{-2}$ Pa) constitutes a limiting pressure for a distance between electrodes of approximately 0.2 mm.

However, the hydrogen partial pressure must be maintained at the selected level even as the hydrogen is consumed and trapped by the getter.

A characteristic of the present invention is to provide, within the inter-electrode gap, a hydrogen source which progressively releases $H^+$ ions along the operation of the screen, that is, along the degassings of oxidizing species from the anode.

Preferably, this source is placed close to the tips, so that the hydrogen released is not trapped by the getter before reaching the microtips.

In order to enable progressive hydrogen release, the source material must be able to only release hydrogen when energized.

This energizing can be thermal. In this case, the temperature raise inside the screen during its operation causes a hydrogen release. The energizing can also result from electron or ion bombardment.

According to a first embodiment of the present invention, the hydrogen source is integrated in insulating bands 8 which separate the phosphor bands of the anode. In this case, the activation of the hydrogen source is essentially performed by electron bombardment. Indeed, some electrons emitted by the microtips touch the edges of the insulating tracks.

According to a second embodiment of the present invention, the hydrogen source is implemented on the cathode side and is for example integrated to the resistive layer which supports the microtips. The source activation then is thermal, the cathode not being bombarded.

A common advantage of the two above-described embodiments is that they distribute the hydrogen source on the entire screen surface and thus guarantee a homogeneous anti-oxidizing effect in the screen.

Another advantage is that they enable automatic regulation of the hydrogen partial pressure in the inter-electrode gap, and thus of the anti-oxidizing means of the microtips of the cathode. Indeed, the activation (thermal or electron bombardment) of the oxygen source is localized in the region of the microtips which are emitting, and which are thus likely to be oxidized.

Another advantage is that they require no modification of the screen structure, but only of the deposition conditions of insulating tracks 8 or of resistive layer 11, as will be seen hereafter.

According to the invention, the deposition parameters of at least one selected layer are adjusted to cause the incorporation of hydrogen in the material of this layer. The hydrogen incorporation and diffusion is adjusted according to the amount of hydrogen which is desired to be released by the material during screen operation, that is, according to the quality of the vacuum in the electrode gap, in particular to the partial pressure of the oxidizing species, and to the energizing means selected for the hydrogen source.

According to a third embodiment, the hydrogen source is comprised of dedicated areas, arranged outside the active area of the screen, for example, at the anode periphery. An energizing source then is implemented on the cathode side facing the dedicated areas. The energizing source can be comprised of an area of microtips facing the hydrogen source outside the active area of the screen.

If such an embodiment requires to modify the screen structure, it has the advantage of supplying an anti-oxidizing means controllable independently from screen operation. Thus, the dedicated energizing source can be provided to be controlled at regular intervals to regenerate the microtips. This dedicated source can also be provided to be controlled from a measurement of the current flowing through the cathode conductors to cause a microtip regeneration phase according to a current threshold from which it is considered that microtip regeneration is desirable.

Several examples of materials which can be chosen to constitute the hydrogen source will be indicated hereafter.

The deposition of the several layers used in the fabrication of a screen generally is performed by plasma-enhanced chemical vapor deposition (PECVD). Such a deposition mode uses mixtures of precursor compounds of the material to be deposited. It is easy to control the hydrogen content added to the precursors. This technique enables to obtain highly-hydrogenated depositions and to easily control the quantity of hydrogen by playing on the deposition parameters (deposition temperature, self-bias voltage, deposition pressure, annealing temperature, etc.).

Among materials likely to be deposited with a high hydrogen content and to lose this hydrogen under thermal, ionic or electronic activation, are in particular hydrogenated silicon, hydrogenated silicon carbide, hydrogenated silicon nitride, hydrogenated silicon oxide, hydrogenated carbon, hydrogenated germanium and hydrogenated oxinitride-based materials.

The selection of the material used depends, in particular, on the location of the hydrogen source.

If the hydrogen source is implemented on the cathode side, the silicon usually constituting resistive layer 11 can be hydrogenated to dispense hydrogen.

If the hydrogen source is comprised of the insulating layers 8 between the phosphor bands of the anode, a material which is both dielectric and easily hydrogenated will be selected, as, for example, silicon carbide or silicon oxide. Silicon nitride, which has the additional advantage of minimizing the oxygen contained in the insulating layers can also be chosen, so that the released hydrogen has the task of reducing the oxidizing species essentially degassed by the phosphors.

When compatible with the function of the layer selected to also constitute the hydrogen source, an amorphous compound will preferably be selected, since it can generate a high amount of hydrogen because its concentration is not limited by a crystalline structure.

The anti-oxidizing effect can also be combined with an anode matrixing effect which improves the contrast of the screen. Such a matrix is generally called a "black matrix" and creates black areas between the phosphor bands of the anode. For this purpose, a compound based on hydrogenated carbon will for example be used to implement bands 8.

Of course, the present invention is likely to have various alterations, modifications, and improvements which will readily occur to those skilled in the art. In particular, the adaptation of the fabrication process of a flat screen to implement the present invention is within the abilities of those skilled in the art according to the functional indications given hereabove.

Further, although the present invention has been described hereabove in relation with a microtip color screen, it also applies to a monochrome screen. If the anode of such a monochrome screen is comprised of two sets of alternate phosphor bands, all the above-described embodiments can be implemented. Conversely, if the anode of the monochrome screen is comprised of a plane of phosphor, the hydrogen source will be comprised either of a dedicated source external to the active screen area, or by the resistive layer on the cathode side.

What is claimed is:

1. A flat display screen including a cathode with microtips for the electron bombardment of an anode (5) having phosphor elements (7), the anode (5) and the cathode (1) being separated by a vacuum space (12), containing a progressive hydrogen release source comprised of a thin resistive layer of a hydrogenated material of the cathode on which the microtips are arranged.

2. A screen according to claim 1, wherein the hydrogen source is comprised of insulating bands (8) separating bands of phosphor elements (7) from the anode (5).

3. A screen according to claim 1, wherein the hydrogen source is implemented at the circumference of the active area of the anode (5) carrying the phosphor elements (7).

* * * * *